US005832052A

United States Patent [19]

Hirose et al.

[11] Patent Number: 5,832,052

[45] **Date of Patent: *Nov. 3, 1998**

[54] X-RAY MICROSCOPE

[75] Inventors: Hideo Hirose, Saitama; Kozo Ando, Tokyo; Yoshinobu Aoyagi, Saitama; Tamio Hara, Tokyo, all of Japan

[73] Assignees: Shimadzu Corporation, Kyoto; The Institute of Physical and Chemical Research, Wako, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 669,709

[22] Filed: Jun. 24, 1996

[30] Foreign Application Priority Data

Jun. 26, 1995 [JP] Japan ..... 7-159143

[51] Int. Cl.[6] ..... G21K 7/00

[52] U.S. Cl. ..... 378/43; 378/210

[58] Field of Search ..... 378/43

[56] References Cited

U.S. PATENT DOCUMENTS 5,528,646 6/1996 Iketaki et al. ..... 378/43

*Primary Examiner*—Craig E. Church

*Attorney, Agent, or Firm*—Nikaido, Marmelstein, Murray & Oram LLP

[57] ABSTRACT

An X-ray microscope utilizing X-rays radiating from a laser-irradiated target so as to form an X-ray image of a specimen placed in a sample cell, the X-ray microscope includes a target for radiating X-rays when the same is irradiated with a laser beam, a sample cell for housing a specimen, the sample cell provided near the surface of target placed opposite to where the target is irradiated with the laser beam, and a detector for forming an X-ray image of the specimen by X-ray penetration, wherein the target, the sample cell and the detector are unified in a unit. The unit is placed at a place where the laser beam is irradiated to the target. A spacer is provided between the target and the sample cell, wherein the size of the spacer is determined depending on a distance between the specimen and the target. With this construction, this facilitates the fabrication of the unit. The unit is placed in the miniature vacuum chamber which comprises a division for housing the unit, and a space provided toward the target. And the vacuum chamber housing the unit is placed in an X-ray microscope.

6 Claims, 5 Drawing Sheets

14
15
51
17
16
15
14
21
17
16
15
14
22
19
13
12
11
20
13
12
11
19
14
19
13
13
1

X-RAY MICROSCOPE

FIELD OF THE INVENTION

The present invention relates generally to an X-ray microscope, and more particularly to an X-ray microscope utilizing X-rays radiating from a laser-irradiated target.

BACKGROUND OF THE INVENTION

An X-ray microscope is known in the art which examines a specimen through an X-ray image obtained from X-rays radiating from a laser-irradiated target such as metal.

There are at least two types of X-ray microscopes known in the art, which will be described with reference to FIGS. 8 and 9. One type is shown in FIG. 8, where X-rays are radiated from a target in a direction in which a laser beam is irradiated to the target, and the other is an embodiment where X-rays are radiated from a target in an opposite direction from where a laser beam is irradiated.

More specifically, in the embodiment of FIG. 8, a specimen 81 is placed facing a source of a laser beam 83 with respect to a target 82, and X-rays 84 radiated from the target 82 are irradiated on the specimen 81. The X-rays penetrating the specimen 81 are detected by a detector such as a photoresist layer formed on a substrate 86, and form an X-ray image through which the specimen 81 is examined. The specimen 81 is placed on the photoresist layer 85, and above the substrate 86 a window 87 is provided through which the X-rays pass the specimen 81 and on to the photoresist layer 85. In this way the substrate 86, the photoresist layer 85, and the X-ray window 87 constitute a sample cell 88.

In the embodiment shown in FIG. 9, the specimen 81 is also placed in a sample cell 88 having a similar structure as shown in FIG. 8 but the sample cell 88 is placed on an opposite side from where a target 91 is irradiated with the laser beam 83. With this arrangement, the part of the X-rays which penetrate the target 91 are irradiated to the specimen 81 and forms an X-ray image on the photoresist layer 85.

In general, X-ray microscopes require that the wavelength of the X-ray is determined in accordance with the kind of the specimen and the purpose of a particular test. To this end, the specific material of the target is selected so as to obtain X-rays having a desired wavelength. Furthermore, as shown FIG. 9, in order to prevent X-rays from radiating from other substances than the target, such as an air, the target 91 and the sample cell 88 or the like are placed within a vacuum chamber 92. In addition, the X-ray microscope shown in FIG. 8 can be placed with the target 82 and the sample cell 88 or the like within a vacuum chamber (not shown).

These X-ray microscopes described above have the following disadvantages:

The X-ray microscope shown in FIG. 8 tend to emit inadequately intense X-rays to be irradiated to a specimen. This embodiment also requires that the sample cell 88 be located at such a distance from the target 82 as to stand in the optical path of the laser beam; for example, the sample cell 88 must be placed at a distance of at least 1 cm from the target 82. In general, X-rays radiated from a spot of not greater than 100 $\mu$m in diameter becomes less intense in reverse proportion to $d^2$ (distance) when the laser beam is focused on the surface of the target. According to this general principle, the embodiment of FIG. 8 has difficulty in achieving sufficiently intense X-rays for examining a specimen.

The X-ray microscope shown in FIG. 9 can obtain more intense X-rays than that of FIG. 8 because the specimen 81 is placed opposite to where the laser beam is irradiated to the target 91, and can therefore be located near the target 91. However, it is necessary to adjust the distance between the specimen 81 and the target 91 based upon the constituent substance of the target. The intensity of X-rays radiating from the target 91 depends on the constituent substance of the target 91, which necessitates frequent adjustment of the distance between the target 91 and the specimen 81 in accordance with the intensity of X-rays radiated from the target 91, so as to irradiate to the specimen 81 with a required X-ray intensity of a disired wavelength. This adjustment is usually effected by changing the position of the specimen 81; more specifically, by adjusting the support of the sample cell 88 because the target 91 is previously placed at a focal point of the laser beam.

The embodiments of FIGS. 8 and 9 requires that the target, the sample cell, and peripheral devices such as supporters and the driving device, are all placed in a relatively large vacuum vessel so as to prevent X-rays from radiating from other components than the target. This configuration requires enlarging the size of the X-ray microscope.

SUMMARY OF THE INVENTION

Accordingly, the present invention is intended to solve the problems pointed out about with known X-ray microscopes. It is an object of the present invention to provide an X-ray microscope allowing a specimen to be placed as near the target as possible so as to expose it to sufficiently intense X-rays, and to facilitate the efficient adjustment of a distance between the target and the specimen.

Another object of the present invention is to provide an X-ray microscope of such a compact size as to eliminate the need to use a large vacuum chamber, thereby reducing the size of an X-ray microscope.

In order to achieve these objects, according to the present invention there is provided an X-ray microscope utilizing X-rays radiating from a laser-irradiated target so as to form an X-ray image of a specimen placed in a sample cell. A target is provided for radiating X-rays when it is irradiated with a laser beam, and a sample cell is provided for housing a specimen therein. The sample cell is provided near the surface of the target placed opposite to where the target is irradiated with the laser beam, and a detector is provided for forming an X-ray image with the X-rays penetrating the specimen. The elements are unified in a unit.

In a preferred embodiment, the unit includes a substrate, a photoresist layer formed on the substrate as the detector, a first space for housing the specimen, with the first space provided adjacent to the photoresist layer. An X-ray window is opposite the photoresist layer through the first space, and a second space is provided on the opposite side of the first space through the X-ray window. The target is positioned opposite the X-ray window with the second space being interposed therebetween.

In a further preferred embodiment, the second space is airtight and filled with an excellent X-ray transmissible gas, such as He gas.

In a still further preferred embodiment the second space is formed by providing a spacer between the target and the X-ray window, wherein the size of the spacer is determined depending on a desired distance between the specimen and the target.

In another embodiment the second space is formed by providing a first spacer and a second spacer between the target and the X-ray window, wherein the size of the first spacer is determined depending on a distance between the specimen and the target, and the second spacer is formed integral with the X-ray window.

In another embodiment, a miniature vacuum chamber is included which includes a division for housing the unit and a space provided toward the target, the miniature vacuum chamber housing the unit being placed at a place where the laser beam is irradiated to the target.

In another embodiment the vacuum chamber housing the unit is placed in an X-ray microscope, such that the surface of the target is positioned at the focal point of the laser beam, thereby ensuring that the vacuum chamber for housing the unit is placed at a predetermined position in X-ray microscope. The specimen is then exposed to the X-rays radiating from the target.

In yet another embodiment a movable framework is provided to enable a plurality units to be mounted and to shift each unit to a place where the target is irradiated with a laser beam, thereby ensuring that a plurality of specimens are continuously exposed to X-rays and examined for a relatively short period of time.

According to the present invention, the target, the sample cell and the detector are unified or integrated into an appropriate configuration for being housed in an X-ray microscope. The target is selected in accordance with the constituent substance of the specimen so as to emit X-rays having a wavelength suited to the nature of the specimen and the purpose of observation. The laser beam is irradiated to the target with the specimen housed within the sample cell. The X-rays radiated from the bottom surface of the target penetrates the specimen and the penetrated X-rays are detected by the detector.

Under the arrangement of the present invention, the specimen is placed in an opposite direction to that in which a laser beam is irradiated to the target. This ensures that the specimen is exposed to intense X-rays, as in the arrangement shown in FIG. 9. In addition, once a suitable unit is selected, the specimen is placed at a fixed position from the target, so that it is not necessary to adjust the distance between the specimen and the target within the X-ray microscope.

The distance between the specimen and the target is selected by determining the size of the spacer inserted between the target and the X-ray window.

Since the unit is placed in the miniature vacuum chamber which comprises a housing division for housing the unit, and a space provided toward the target, the specimen is prevented from being exposed to X-rays radiated from any other impure substances than the target. In general, an area which X-rays can be radiated from other substances (such as an air) than the target in the case where the laser beam is focused on the target is the vicinity of the focal point of laser beam; more specifically the vicinity of the target surface irradiated with laser beam. Therefore, the vacuum chamber of the present invention is provided with a sufficient capacity for accommodating the unit and for allowing a space adjacent thereto to be provided toward the target, so that the specimen is protected from exposure to X-rays radiation from any substances other than the target.

BRIEF DESCRIPTION OF THE DRAWINGS

FIGS. 5A-1 to 5A-3, 5B-1, 5B-2 and 5C are a diagrammatic view showing the steps of fabricating the unit according to the present invention;

DETAILED DESCRIPTION OF THE PREFERRED EMBODIMENT

Figure 1:
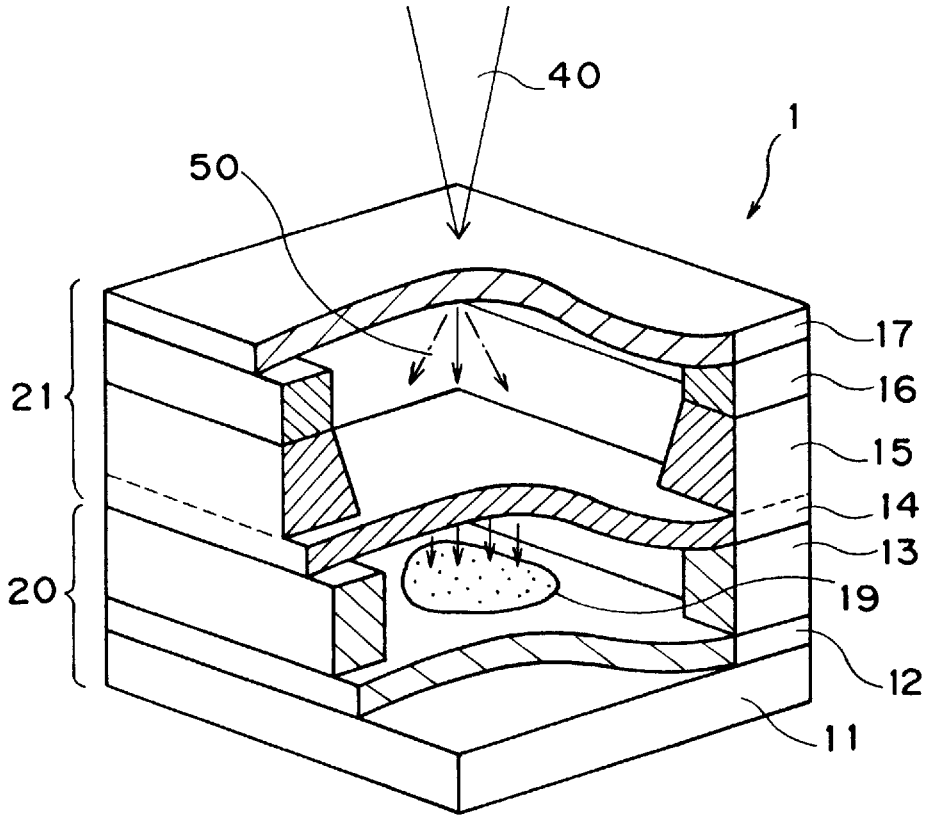
FIG. 1 is a partially sectional perspective view showing a unit including a target, a sample cell and a detector.
Figure 2:
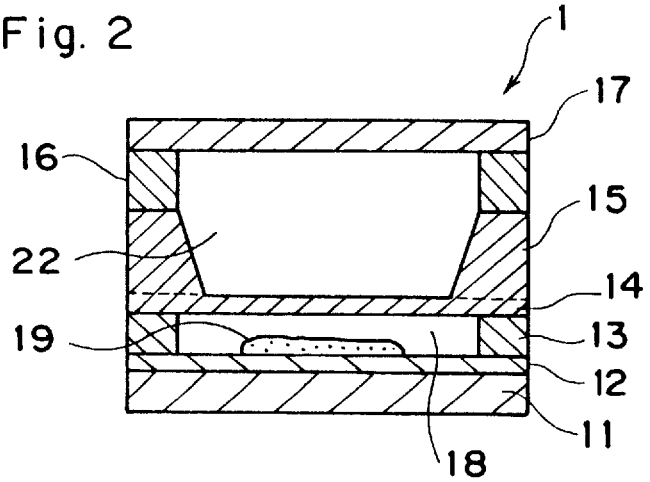
FIG. 2 is a vertical cross-sectional view of the unit shown in FIG. 1.

Referring to FIGS. 1 and 2, a first embodiment of the X-ray microscope of the present invention will be described.

FIG. 1 is a partial sectional view showing a unit in which a target 17, a sample cell 20 and a detector 12 are integrated in a unit 1, and FIG. 2 is a vertical cross-section showing the unit 1.

In addition to the target 17, the unit 1 includes a substrate 11, a photoresist layer (detector) 12 formed on the surface of the substrate 11, a first spacer 13 provided on the photoresist layer 12, and an X-ray window 14 placed on the first spacer 13. A second spacer 15 is placed on the X-ray window 14, and a third spacer 16 placed on the second spacer 15.

The first spacer 13 maintains a first space 18 between the photoresist layer 12 and the X-ray window 14. A specimen 19 is placed in the first space 18. The substrate 11 and the first space 18 therefore constitute a sample cell 20 for housing the specimen 19, and the X-ray window 14 functions as a cover closing the open end of the sample cell 20. The first space 18 may be maintained at an atmospheric pressure, and before the specimen 19 is placed in the space 18, the unit 1 is divided into two parts from the border between the first spacer 13 and the X-ray window 14. These two parts include a sample cell 20 and a target 21 including the window 14, the spacers 15, 16, and the target 17.

The specimen 19 is placed on the photoresist layer 12 before the unit 1 is assembled. Then the first spacer 13 and the X-ray window 14 are joined into an entity as shown in FIG. 1. Finally, the assembled unit 1 is placed in an X-ray microscope.

The second spacer 15 and the third spacer 16 define a second space 22 between the X-ray window 14 and the target 17, and the second space 22 is sealed airtight against the atmosphere with an X-ray transmissible gas, such as He gas, confined at a pressure of a few Torrs. The X-ray transmissible gas disperses fine particles (debris) occurring when a laser beam 40 is irradiated to the target 17, thereby preventing the fine particles from adhering to the X-ray window 14 and the specimen 19.

The substrate 11 is preferably made of silicon to a thickness of 0.5 mm or so, and the photoresist layer 12 formed thereon is made of a material, such as PMMA, which permits recording of an X-ray image. The first spacer 13 can be made of metal such as aluminum or stainless steel to a thickness of 5 μm to 50 μm.

The X-ray window 14, designed to select a wavelength of X-ray which is irradiated to the specimen 19 or to prevent debris scattering from the target 17 from adhering to the specimen 19, can be made of SiN or polyimide resin film or the like. The X-ray window 14 can be made in one piece with the second spacer 15 as shown in dotted lines in FIG. 1; more specifically, the substrate of Si is doped with nitrogen to form an SiN layer on one side thereof and the other side is etched. The second spacer 15 can be as thick as approximately 0.5 mm, to minimize the impact of debris upon the X-ray window 14 by providing a space between the target 17 and the X-ray window 14.

The thickness of the third spacer 16 is selected in accordance with the constituent substance of the target 17, so that the distance between the target 17 and the specimen 19 can be adjusted depending upon the kind of the target 17 such as metal or any other material. The thickness is selected to be in a range of 1 to 2 mm.

The target 17 is made of a material which can emit X-rays in response to the laser beam irradiated thereto, and the target is selected in accordance with the wavelength of X-ray that is suitable for the specimen 19. The constituent substance can be selected from metal or plastic such as Al, Au, Mo, Ta or "Kapton" (trademark), and the thickness of it can fall in a range of 1 μm to 100 μm.

Figure 3:
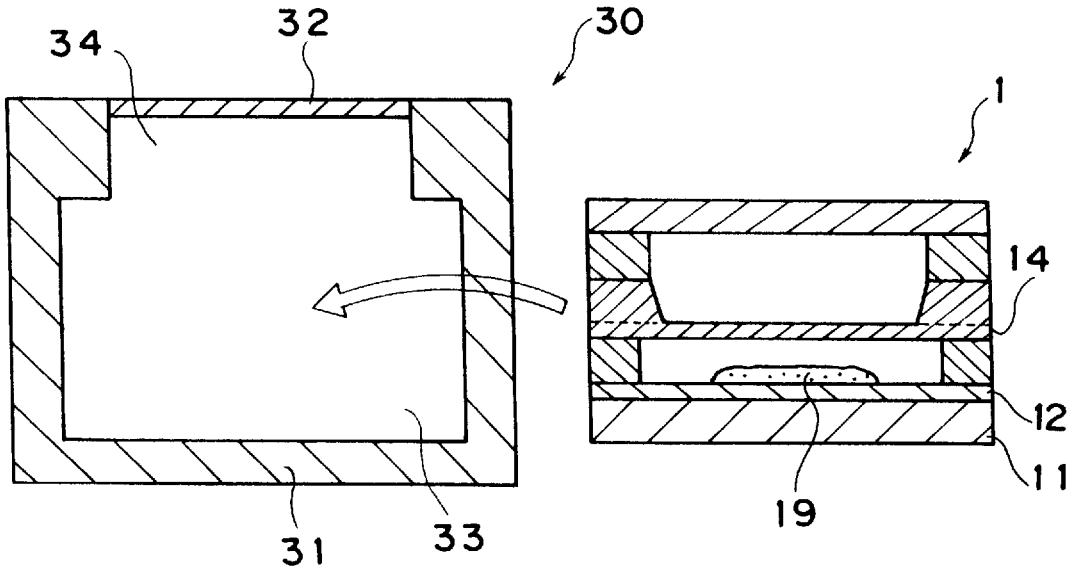
FIG. 3 is a vertical cross-sectional view of a vacuum chamber 30 for housing the unit.

The unit 1 is placed in a vacuum chamber 30 as shown in FIG. 3, and then the vacuum chamber 30 is placed at a position in an X-ray microscope where the laser beam 40 is irradiated to the target 17.

The vacuum chamber 30 is box-shaped, and has a body 31 made of metal such as Al and stainless steel, and a transparent laser transmissible lid 32 closing the open end of the body 31. The internal space of the chamber 30 includes a main space 33 for housing the unit 1 and a subordinate space 34 between the main space 33 and the transparent lid 32, and the inside of the vacuum chamber 30 is evacuated. The unit 1 is placed in the vacuum chamber 30 with the target 17 facing the transparent lid 32. In this state the subordinate space 34 adjacent to the target 17 is evacuated, the target 17 is irradiated with a laser beam 40.

Figure 4:
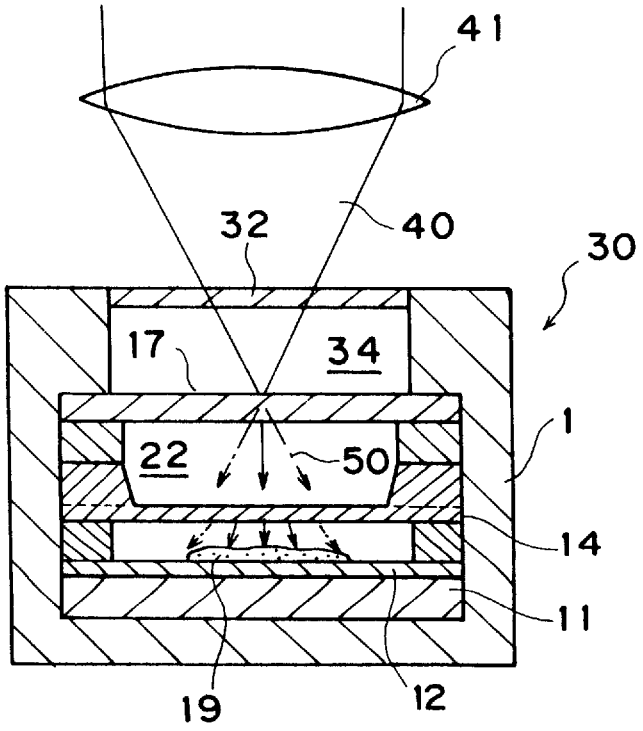
FIG. 4 is a vertical cross-sectional view of an assembly of the unit and the vacuum chamber 30, wherein the unit is located at a position where the laser beam 40 is focused.

According to the embodiment shown in FIG. 4, the laser beam 40 can be focused on the surface of the target 17 by placing the vacuum chamber 30 housing the unit 1 at a predetermined position by considering a relative relationship among the optical system 41 for focusing the laser beam 40, the dimension of the vacuum chamber 30, and the position thereof.

The unit 1 can be miniaturized to such an extent that its side dimension is 10 to 20 mm, and the vacuum chamber 30 is sized to such an extent that the main space 33 of the vacuum chamber 30 can house the unit 1 and the subordinate space 34 is smaller than the main space 33.

Figures 1, 2, 3, 5A, 5B, 5C:
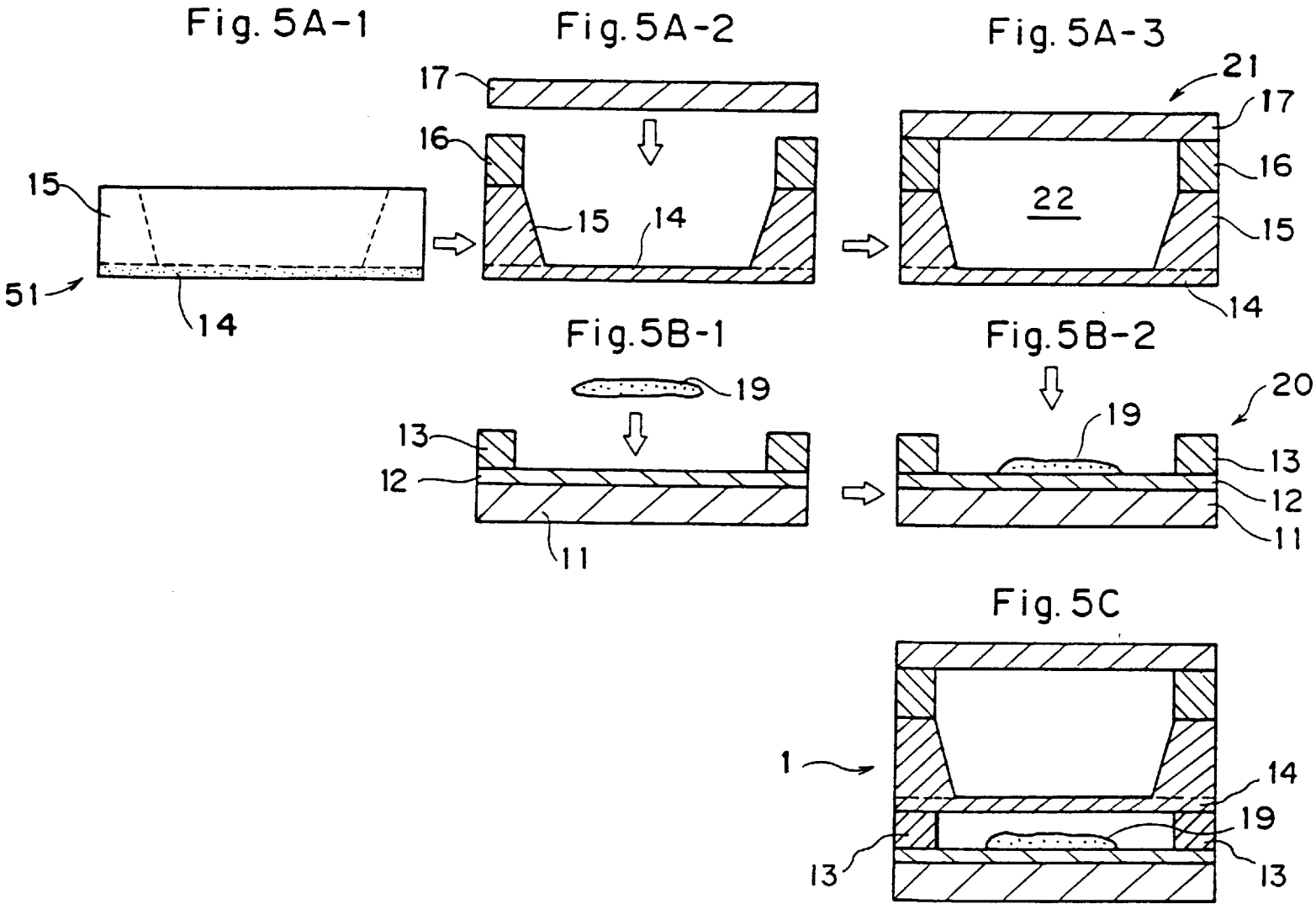

Referring to FIGS. 5A-1 to 5C, a typical manner of fabricating the unit 1 and a process of exposing a specimen to X-rays will be described, such that the sample cell 20 and the target 21 are separately fabricated.

More specifically, as shown in FIG. 5A-1, the Si substrate 51 is doped with nitrogen on one side to form an SiN layer, and is etched on the other side. In this way the X-ray window 14 of the SiN layer and the second spacer 15 on the periphery thereof are formed as one piece. Then, as shown in FIGS. 5A-2 and 5A-3, the third spacer 16 is formed on the second spacer 5 and the target 17 is joined to the third spacer 16. In this way the target division 21 including an airtight space 22 is fabricated. Because of the possibility of selecting the wavelength of X-ray to be irradiated to the specimen in accordance with the kind of the specimen and the object of the observation, several kinds of targets 17 are prepared so as to meet required wavelengths. The strength of X-rays irradiated and the quantity of fine particles dispersed from the target 17 toward the X-ray window 14 differ depending upon the kind of the material of the target 17. The thickness of the third spacer 16 can therefore be determined in accordance with the kind of the target 17. As a result, it is possible to equalize the conditions of the X-rays irradiated to the specimen 19 and the influence of the fine particles. When the target division 21 is fabricated, the second space 22 is filled with He gas, etc. at a pressure of a few Torrs.

As shown in FIG. 5B-1, the specimen division 20 is fabricated by applying a photoresist such as PMMA to the surface of the Si substrate 11 to form a photoresist layer 12, and by joining the second spacer 13 to the photoresist layer 12.

The specimen 19 is placed on the photoresist layer 12 as shown in FIG. 5B-2. Then the target division 21, which has one of the targets 17 selected depending upon the constituent substance of specimen 19, is placed on the specimen division 20 as shown FIG. 5C and the first spacer 13 is finally joined to the X-ray window 14. In this way the unit 1 is assembled. The joint is effected by use of cyanoacrylate-based adhesive.

Then, the unit 1 is placed in the vacuum chamber 30 as shown in FIG. 3, and the vacuum chamber 30 is evacuated to a pressure of approximately $10^{-3}$ Torrs, and the vacuum chamber 30 is disposed at a predetermined position within an X-ray microscope (not shown) as shown in FIG. 4.

As is evident from FIG. 4, the surface of the target 17 is positioned at the focal point of the laser beam 40 in the X-ray microscope, so that the target 17 irradiated with the laser beam 40 immediately radiates X-rays and debris. The X-rays are radiated toward both the vacuum window 32 and the second space 22 in the unit 1. Portion 50 of the X-rays toward the second space 22 is irradiated to the specimen 19 on the photoresist layer 12 through the X-ray window 14.

The surface of the laser-irradiated target 17 faces the evacuated subordinate space 34, and the second space 22 in the unit 1 is filled with X-rays transmissible gas such as He gas, thereby ensuring that there can be no other impure substance likely to radiate X-rays than the target 17. Thus the specimen 19 is not exposed to any other than the X-rays 50 radiating from the target 17.

The debris or fine particles coming out from the target 17 together with the X-rays are dispersed in the He gas in the second space 22, so that they are prevented from adhering to the X-ray window 14 and other walls.

In this manner, the specimen 19 is exposed to the X-rays, and then the unit 1 is taken out of the vacuum chamber 30, and the substrate 11 formed a photoresist layer 12 is separated from the unit 1. An X-ray image on the photoresist layer 12 is observed by means of an AFM or an electronic microscope.

Whatever constituent substance a specimen may have, it can be observed by the same procedure by selecting a target division selected according to the constituent substance, and joining it to the sample cell 20 to assemble the unit 1 which is then placed in the vacuum chamber 30 to effect the exposure of the specimen.

As is evident from the foregoing description, the unit 1 is replaced depending upon the constituent substance of the specimen. The vacuum chamber 30 can be repeatedly used until it deteriorates.

A specimen is first placed in the sample cell 20, and the target division 21 holding a target selected according to the constituent substance of the specimen is joined to the sample cell 20 to assemble the unit 1 which is then placed in the vacuum chamber 30. After the vacuum chamber 30 is evacuated, it is placed at a predetermined position in an X-ray microscope. Then, the specimen is exposed to the X-rays radiating from the target. The vacuum chamber 30 only needs to be slightly larger than the unit 1, so that the entire size of the X-ray microscope can be considerably reduced.

Figure 6A:
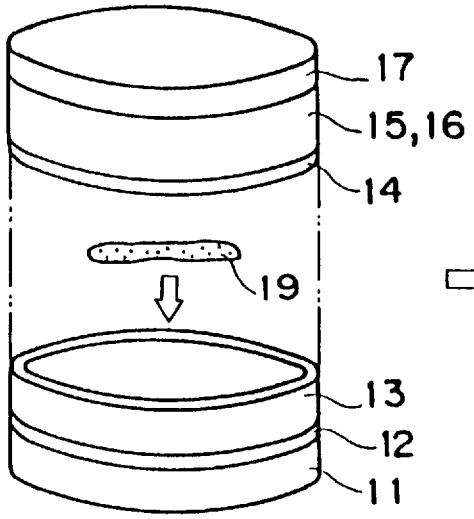
FIG. 6 is a view showing a modified version of the unit according to the present invention.
Figure 6B:
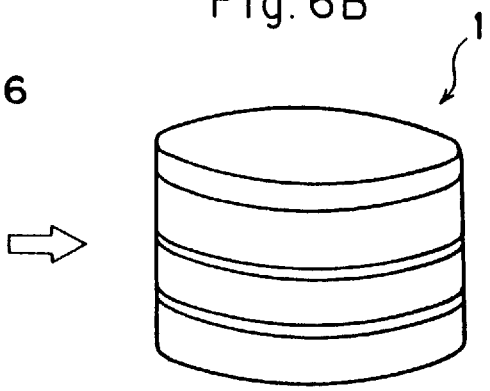

The shape of the unit 1 is not limited to a rectangular solid one but can be various such as a cylindrical shape as a whole as shown in FIG. 6. In this case the shape of the vacuum chamber preferably corresponds to that of the unit 1.

Figure 7:
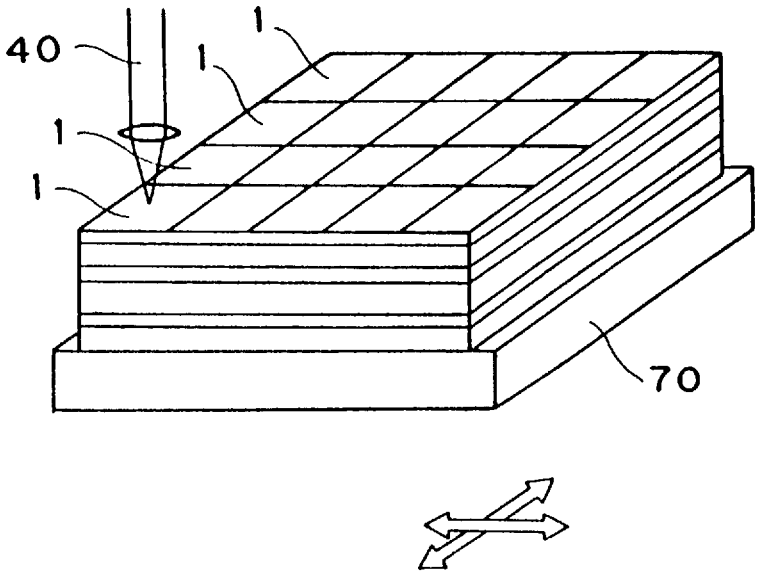
FIG. 7 is a perspective view showing a further modified version of the unit according to the present invention, wherein the movable stage 70 is used in position.
Figure 8:
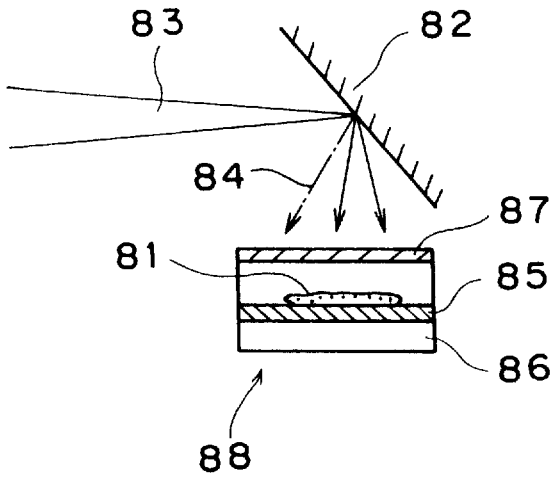
Fig. 8 PRIOR ART
FIG. 8 is a diagrammatic view exemplifying a prior art X-ray microscope; the X-ray microscope is one type where X-rays radiated from a target in a direction to which a laser beam is irradiated to the target are irradiated to the specimen.
Figure 9:
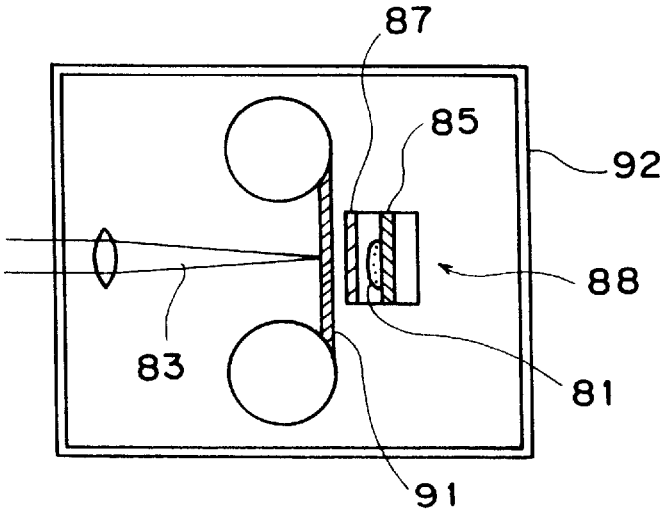
Fig. 9 PRIOR ART
FIG. 9 is a diagrammatic view exemplifying another type of prior art X-ray microscope; the X-ray microscope is another type where X-rays radiated from a target in an opposite direction to where a laser beam is irradiated to the target.

Referring to FIG. 7, another embodiment will be described:

This embodiment is characterized in that it includes a movable framework 70 on which a plurality of units 1 having the same shape and size are mounted. Each unit 1 includes a target, a sample cell and a detector, and the plurality of units are closely arranged in matrix on the framework 70. The framework 70 is movable along the X- and Y-axis so that each unit 1 is successively shifted to a place where the laser beam 40 is irradiated.

Each unit 1 is fabricated in the same manner as described above, in which the target is selected in accordance with the constituent substance of the specimen to be examined. The thickness of the third spacer in the unit 1 is varied in accordance with the constituent substance of the target, thereby differentiating the heights of the units. In order to make up for differences in the heights of the units, appropriate spacers are inserted between the bottoms of the units 1 and the framework 70 so that the top surfaces of the targets correspond to the respective focal points of the laser beam 40.

In the embodiment shown in FIG. 7, the vacuum chamber may have a size which can cover the top surface of the framework 70. Alternatively, each unit 1 may be contained in a vacuum chamber 30 which is identical in structure to that shown in FIG. 3, and the vacuum chambers 30 may be mounted on the movable framework 70.

The movable framework 70 is effective to obtain X-ray images of a plurality of specimens.

What is claimed is:

1. An X-ray microscope utilizing X-rays radiating from a laser-irradiated target so as to form an X-ray image of a specimen placed in a sample cell, the X-ray microscope comprising:

a target for radiating X-rays when the target is irradiated with a laser beam;

a sample cell for housing a specimen, the sample cell provided near the surface of the target and placed opposite to where the target is irradiated with the laser beam; and a detector for forming an X-ray image of the specimen by X-ray penetration, wherein the target, the sample cell and the detector are integrated in a single unit, wherein the single unit comprises a substrate, a photoresist layer formed on the substrate as a detector, a first space for housing the specimen therein, the first space provided to be adjacent to the photoresist layer, an X-ray window opposite the photoresist layer through the first space, and a second space on the opposite side of the first space through the X-ray window, wherein the target is positioned opposite the X-ray window through the second space, and wherein the second space is formed by providing a spacer between the target and the X-ray window, wherein a distance between the specimen and the target is variable by selecting the size of the spacer, wherein an increase in the size of the spacer causes an increase in the distance between the specimen and the target, and wherein a decrease in the size of the spacer causes a decrease in the distance between the specimen and the target.

2. The X-ray microscope according to claim 1, further comprising a movable framework for enabling a plurality units to be mounted and shifting each unit to a place where the laser beam is irradiated to the target.

3. The X-ray microscope according to claim 1, wherein the second space is airtightly confined toward the atmosphere and filled with an X-ray's transmissible gas.

4. The X-ray microscope according to claim 1, further comprising a vacuum chamber which comprises a housing division for housing the unit, and a space provided toward the target, the vacuum chamber housing the unit placed at a position where the laser beam is irradiated to the target.

5. The X-ray microscope according to claim 4, wherein the vacuum chamber housing the unit is configured such that the surface of the target is positioned at a focal point of a laser beam from an external laser beam source.

6. The X-ray microscope according to claim 1, wherein the second space is formed by providing a first spacer and a second spacer between the target and the X-ray window, wherein the second spacer is formed integral with the X-ray window.

* * * * *